US006561672B2

(12) United States Patent
Lessard

(10) Patent No.: US 6,561,672 B2
(45) Date of Patent: May 13, 2003

(54) ILLUMINATED HOLDER

(76) Inventor: Lloyd E. Lessard, Sourcing 1000, Inc., 81995 Mountain View La., LaQuinta, CA (US) 92253

( * ) Notice: Subject to any disclaimer, the term of this patent is extended or adjusted under 35 U.S.C. 154(b) by 0 days.

(21) Appl. No.: 09/943,339

(22) Filed: Aug. 31, 2001

(65) Prior Publication Data

US 2003/0043578 A1 Mar. 6, 2003

(51) Int. Cl.[7] ..... F21V 33/00
(52) U.S. Cl. ..... 362/234; 362/154; 362/276
(58) Field of Search ..... 362/86, 23, 127, 362/132, 134, 234, 154, 237, 240, 253, 410, 276; 968/576, 404, 408, 410, 398; 368/67, 278; 40/714, 715, 722, 725, 728

(56) References Cited

U.S. PATENT DOCUMENTS

| | | | | | |
|---|---|---|---|---|---|
| 1,433,370 | A | * | 10/1922 | Goldsmith | 362/234 |
| 1,442,896 | A | | 1/1923 | Maier | |
| 3,368,068 | A | * | 2/1968 | Cronheim | 362/234 |
| 4,020,337 | A | * | 4/1977 | Chatten | 362/234 |
| D244,241 | S | | 5/1977 | Engelman | |
| 4,216,464 | A | | 8/1980 | Terry | |
| 4,285,028 | A | | 8/1981 | Sundin et al. | |
| 4,507,653 | A | | 3/1985 | Bayer | |
| 4,584,633 | A | | 4/1986 | Comfort | |
| 4,630,248 | A | * | 12/1986 | Scott | 340/566 |
| 4,722,038 | A | | 1/1988 | Comfort | |
| 4,858,084 | A | | 8/1989 | Sheryll | |
| 4,924,366 | A | * | 5/1990 | Shemitz et al. | 362/410 |
| 4,989,253 | A | | 1/1991 | Liang et al. | |
| 5,054,007 | A | | 10/1991 | McDonough | |
| 5,677,675 | A | | 10/1997 | Taylor et al. | |
| D408,145 | S | | 4/1999 | Au | |
| 5,926,090 | A | | 7/1999 | Taylor et al. | |
| 6,028,517 | A | | 2/2000 | Sansone et al. | |
| D425,863 | S | | 5/2000 | Yu | |

FOREIGN PATENT DOCUMENTS

| | | |
|---|---|---|
| DE | 43 05 603 A1 | 8/1994 |
| EP | 0 138 206 A2 | 4/1985 |
| FR | 2 639 526 A1 | 6/1990 |

* cited by examiner

*Primary Examiner*—Y. My Quach-Lee
(74) *Attorney, Agent, or Firm*—Richard C. Litman

(57) ABSTRACT

A sound activated illuminated holder for finding objects such as glasses, combs, napkins, etc. in the dark. The audibly activated holder has a base, a body portion and a first and second illumination end for illuminating the holder and any retained objects to improve visibility at a distant for a user. The body portion of the holder includes a cavity having a predetermined volume for holding a variety of objects. At least one sound sensor is mounted within the base of the device for sensing audible sounds from a user within a predetermined sensing range or distance. A dual illumination source arrangement is provided which provides a dual column of light for easily identifying objects in and around the device at night.

17 Claims, 9 Drawing Sheets

ILLUMINATED HOLDER

BACKGROUND OF THE INVENTION

1. Field of the Invention

The present invention relates generally to article holders. More specifically, the invention is an audibly activated illuminated receptacle for holding and locating various objects, particularly in the dark.

2. Description of the Related Art

Numerous illuminated devices have been devised for improving visibility of instruments or retained objects at night. Evidence of these particular devices can be seen in U.S. patents issued to Maier (U.S. Pat. No. 1,442,896), Comfort (U.S. Pat. Nos. 4,584,633 and 4,722,038), Sheryll (U.S. Pat. No. 4,858,084), and Sansone et al. (U.S. Pat. No. 6,028,517). These devices include improvements which provide night light for watch holders, eyeglasses holders and illumination coasters and decorative illuminated animations for bedroom lamps. Early attempts were made to include combination bedroom lamp and clock features as described in U.S. Pat. No. 4,285,028 issued to Sundin et al.; however, such devices required the use complex features such as a built in time-controlled mechanism that trips an on-off switch in the electric circuit to the lamp for projecting images upon a bedroom ceiling at night. As further described below, it will be seen that most of these conventional device required the use of an alternating current source as a predominant set back. The present invention, an illuminated holder, contrary to conventional illuminated devices described hereinbelow, is a voice activated unit which provides a dual-lamp column arrangement for providing greater luminosity with minimum voltage output utilizing a direct current power source.

Voice activation features have been found among conventional devices, particularly in the utilization of medical devices or voice activated microscopes. U.S. Pat. No. 4,989,253 issued to Liang et al. discloses a voice activated microscope which permits the precise location of the microscope and precise focusing by uttered voice commands. Other devices include a sound responsive light belt and a hand-clap activated cat repelling device described in U.S. patents issued to Terry (U.S. Pat. No. 4,216,464) and McDonough (U.S. Pat. No. 5,054,007), respectively. While these devices illustrate the use of voice commands or sound for activating certain features of the respective devices, neither teaches or fairly suggests the illuminated holder of the present invention.

U.S. patent issued to Bayer (U.S. Pat. No. 4,501,653) and Taylor et al. (U.S. Pat. Nos. 5,677,675 and 5,926,090) disclose complex detector circuits which include processors for executing adaptive actuation signal recognition patterns from noise. These circuit units have applications which involve direct attachment to a lost article. A similar device is described in the European Patent granted to Pösch (EU 0 138 206 A2).

Other patents to Engleman (Des. 244,241), Au (Des. 408,145), Yu (Des. 425,863) Maitenaz (FR 2 639,526) and Basler et al. (DE 43 05 603 A1) are merely directed to general ornamental or conventional features of general relevance.

None of the above inventions and patents, taken either singularly or in combination, is seen to describe the instant invention having a dual-lamp column arrangement for providing greater illumination with minimum voltage output.

Thus a illuminated holder solving the aforementioned problems is desired.

SUMMARY OF THE INVENTION

The invention is a sound-activated illuminated holder which facilitates finding objects such as glasses, combs, napkins, etc. in the dark. The audibly activated holder has a base, a body portion and first and second illumination ends for illuminating the holder and any retained objects. The body portion of the holder includes a cavity having a predetermined volume for holding a variety of objects. At least one sound sensor is mounted within the base of the device for sensing audible sounds within a predetermined sensing range or distance. A dual illumination source arrangement is provided which provides light at night on a first and second side of the body portion of the holder. A set of 1.5 Volt lamps provides light within a column of corresponding removable lamp covers via a DC power source which generates power rated at a voltage provided by two AA batteries. The device is a low voltage device which drives a sensor circuit with a selective switch arrangement for inactive use. The power source provides power sequentially to the sensor and first and second illumination sources as a closed loop circuit when active.

Accordingly, it is a principal object of the invention to provide an illuminated holder for effectively finding a variety of objects at night.

It is another object of the invention to provide an illuminated holder having a dual-lamp system which provides maximum luminosity at low voltage through a voice activated circuit.

It is a further object of the invention to provide an illuminated holder which is light weight and simple to use.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a sound activated illuminated holder which facilitates finding retained objects O such as glasses, combs, napkins, etc. in the dark. The preferred embodiments of the present invention are depicted in FIGS. 1–6, and are generally referenced by numerals 7 and 8, respectively.

Figure 1:
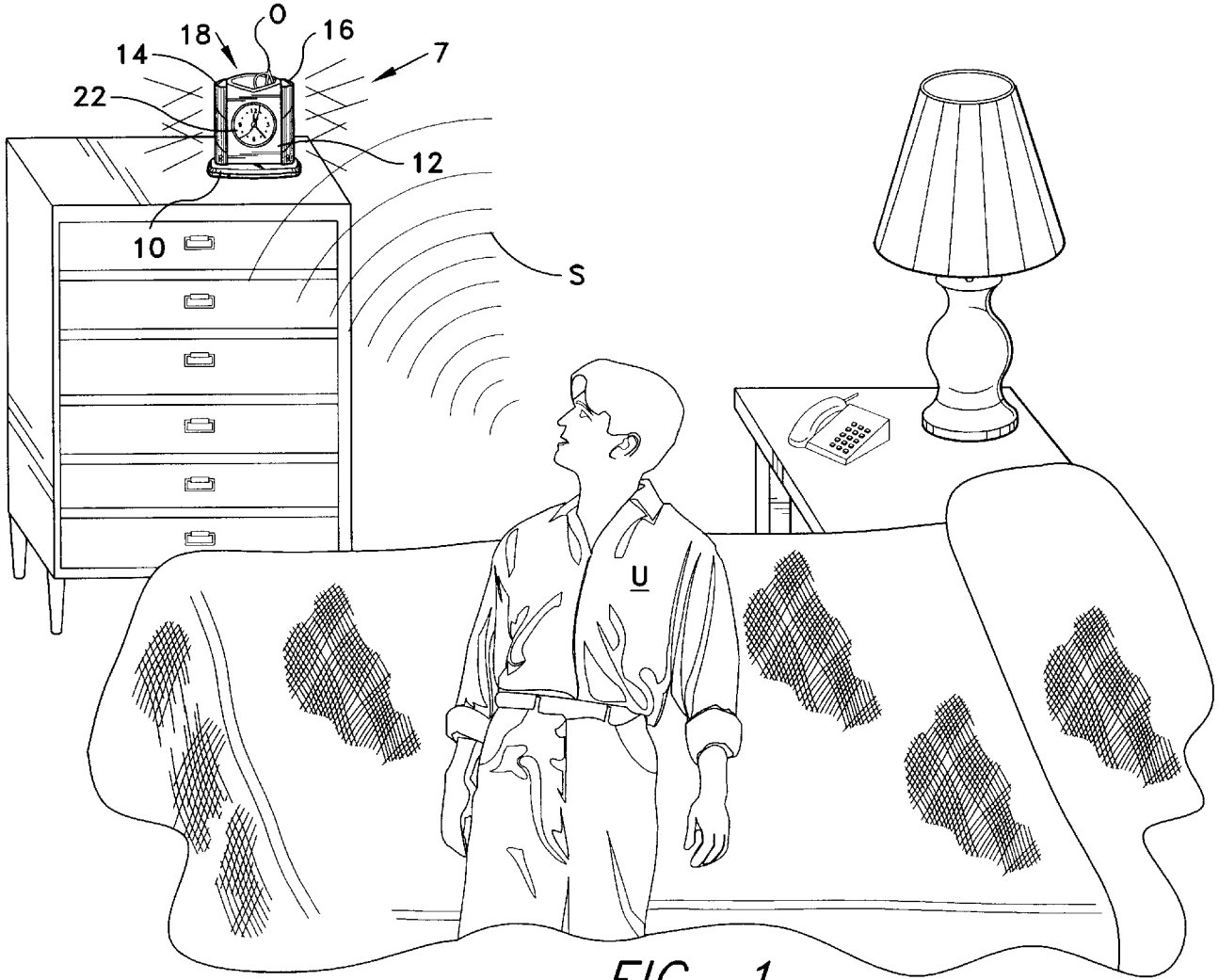
FIG. 1 is an environmental, perspective view of an illuminated holder according to the present invention.
Figure 2A:
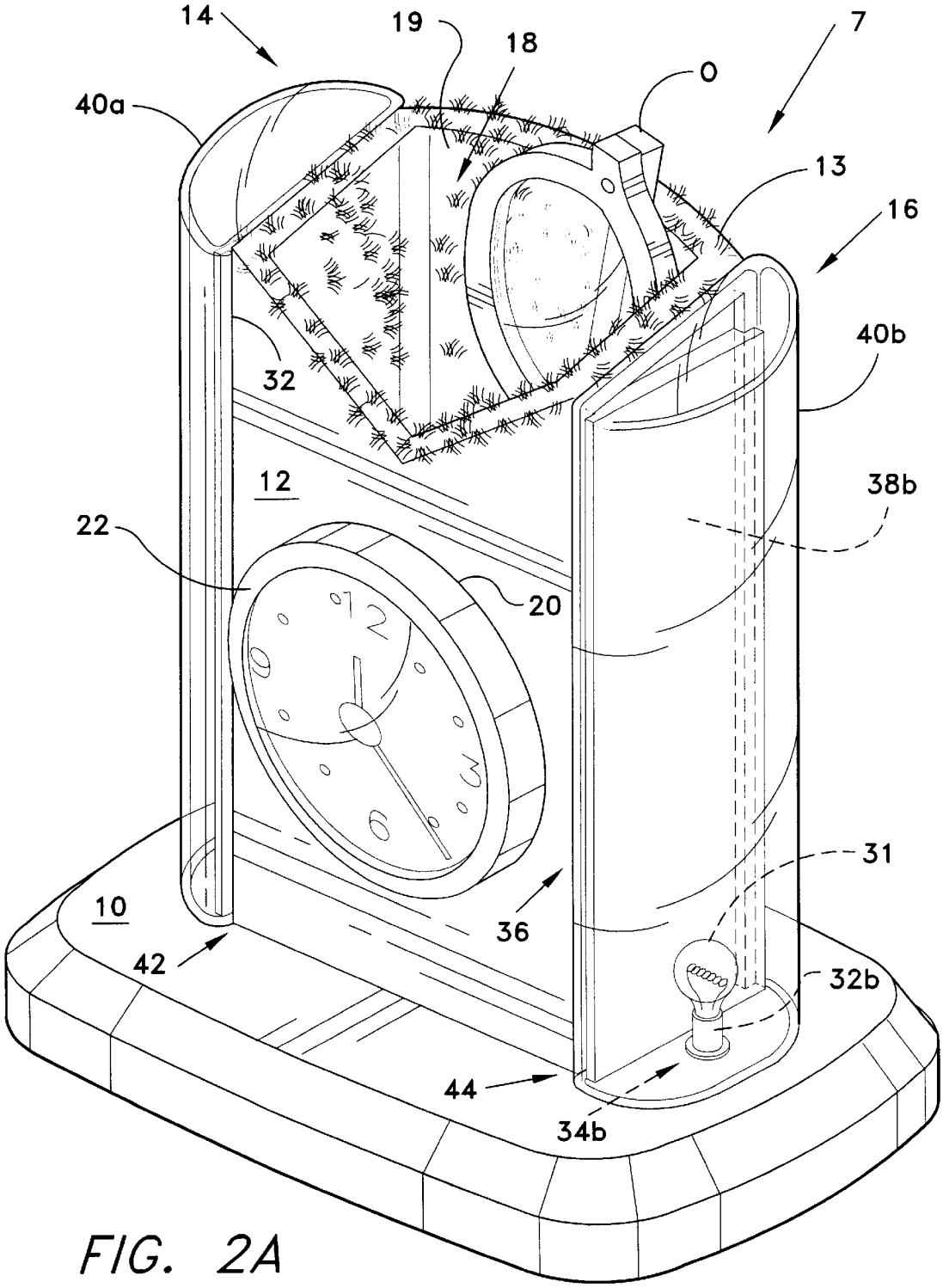
FIG. 2A is a front perspective view of the illuminated holder, illustrating a front clock-face disposed within a central body portion, and with eye glasses retained within the holder.

As diagrammatically illustrated in FIG. 1, the illuminated holder 7 is shown in environmental perspective view. A user U is seen sounding verbal commands or sound S for audibly activating the illuminated holder 7. As shown in FIG. 2A, the illuminated holder 7 comprises a base 10, a body portion 12 and first and second illuminated sides 14 and 16, respectively. The body portion 12 has a cavity 18 formed therein with predetermined volume capacity for holding a variety of objects O. The cavity 18 of the body portion 12 is lined with a non-scratch material 19 such as fur, cotton, silk or the like which extends around a top perimeter portion 13 of the body portion 12 and completely within the cavity 18.

Figure 2B:
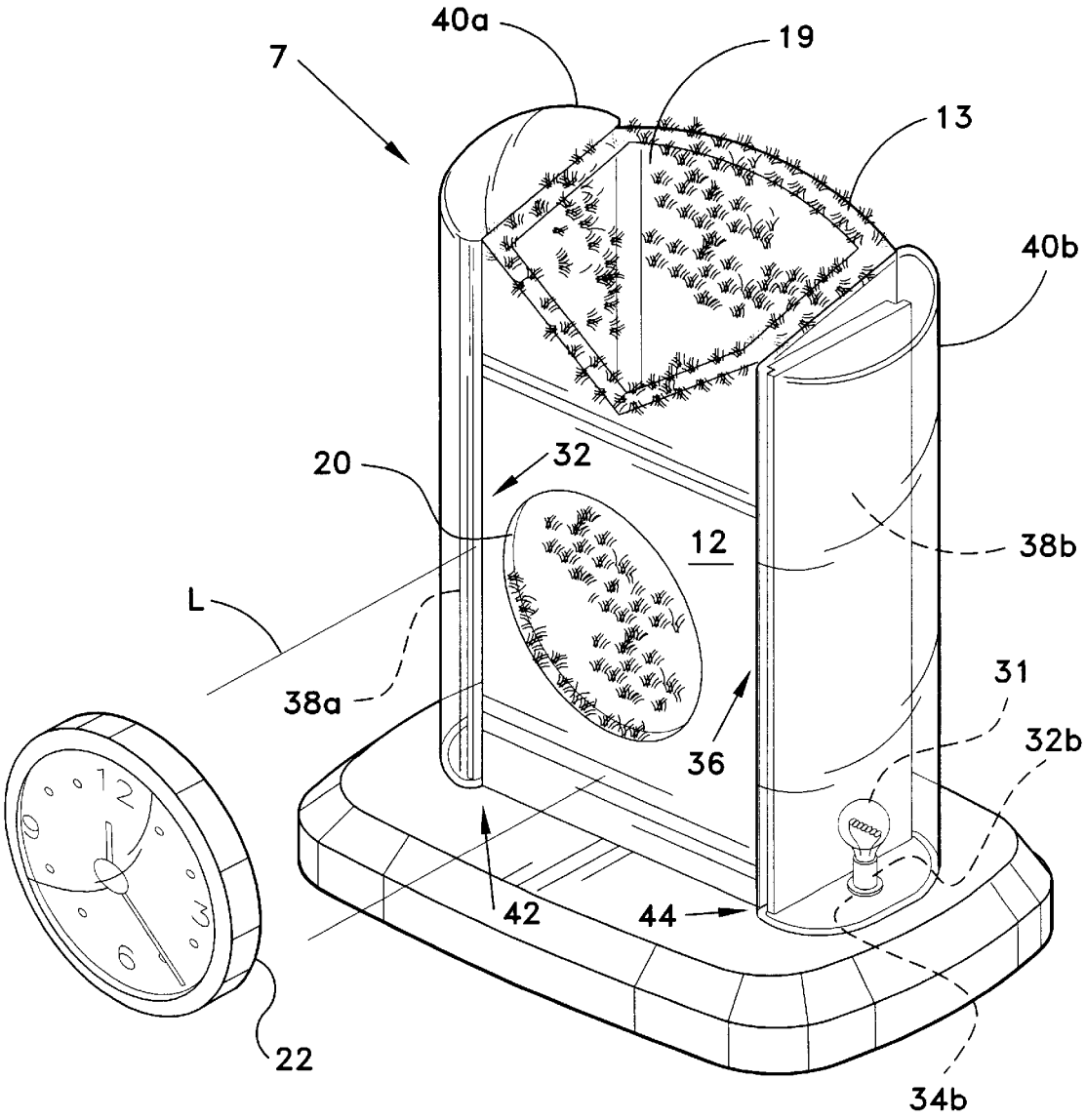
FIG. 2B is an exploded perspective view of the illuminated holder, illustrating a front clock-face element exploded from a body portion of the illuminated holder.
Figure 2C:
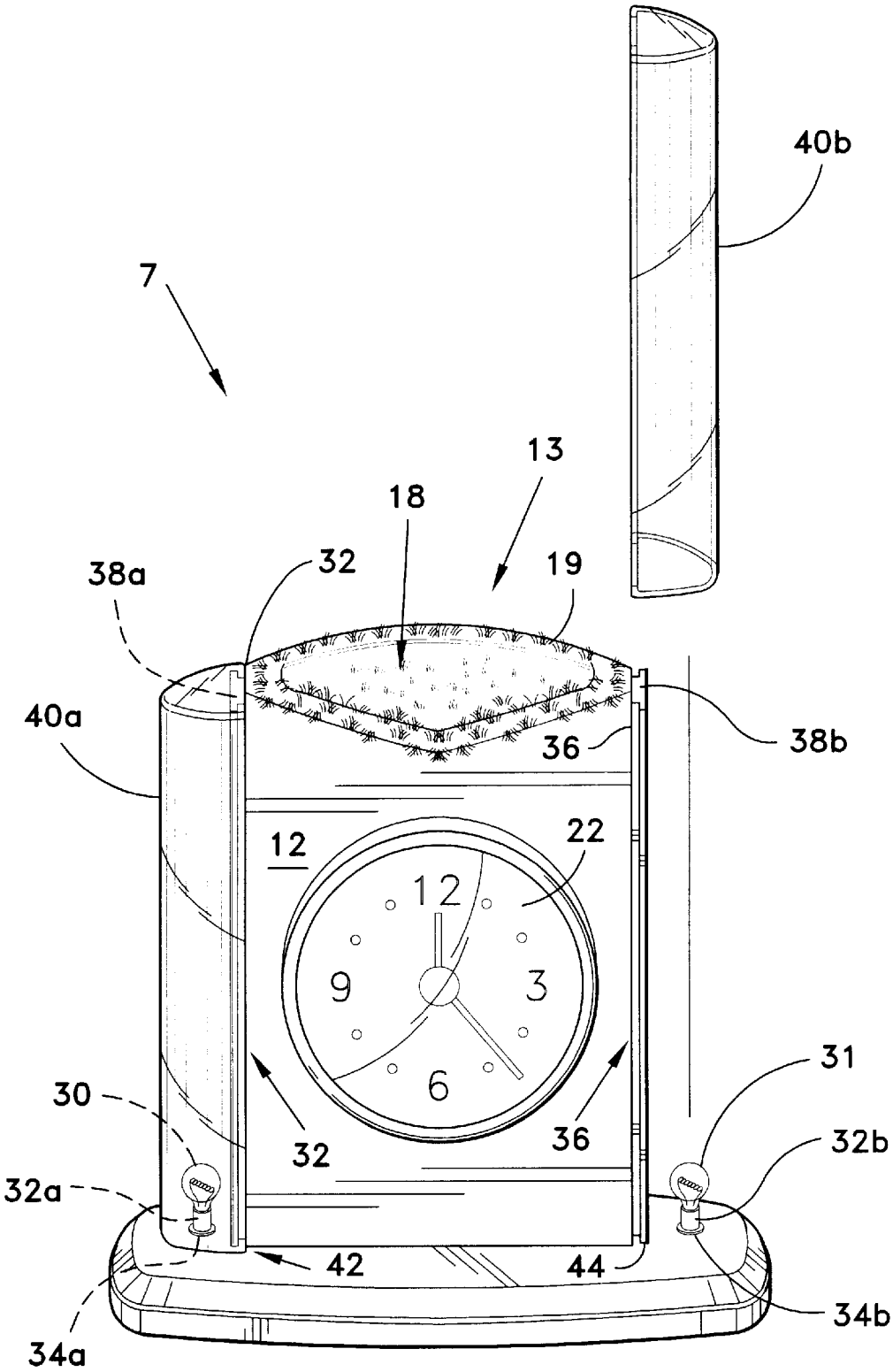
FIG. 2C is an exploded perspective view of the illuminated holder, illustrating lines of attachment of a removable illuminated cover with a side portion of the holder via T-shaped edge portion of the body of the holder.

As diagrammatically illustrated in FIG. 2B, the illuminated holder 7 according to the first embodiment is shown wherein the body portion 12 of the illuminated holder 7 has a central aperture 20 and an operative clock element 22 removably disposed therein. The operative clock element 22 is shown in an exploded perspective with lines of attachment L to illustrate the aperture 20 and clock 22 mutually dimensioned and sized to provide a clock element 22 removably friction-fitted within the central aperture 20. Accordingly, the clock element 22 is an independent clock device which does not require power from the illuminated holder 7. Thus, any number of independent operative clock devices 22 can be used in combination with the holder 7.

While the geometric construction of the aperture 20 and clock element 22 are shown as being generally circular, any geometrical configuration can be used as a matter of personal choice or design preference. Such modifications are considered to be well within the knowledge of one having ordinary skill in the relevant art. With respect to the first and second illuminated side features 14 and 16 illustrated in FIGS. 1–2C, the illuminated holder 7 comprises a first lamp or bulb 30 for providing illumination of the holder 7 on a first side 32 of the body portion 12. The first illumination lamp or bulb 30 is electrically connected to a bulb receptor 32*a* disposed within a first base portion 34*a* of the holder 7 as a removable bulb 30 feature.

On a second side 36, the illuminated holder 7 includes a second lamp or bulb 31 electrically connected to a receptor 32*b* disposed within a second base portion 34*b* for providing light for the holder 7 along the second side 36 of the body portion 12. The second lamp 31 (including lamp 30) is operatively and releasably disposed within the second base portion 34*b* of the holder 7 for quick and simple removal for repairs or the like. Each lamp 30, 31 is rated at 1.5 Volts for providing the required illumination. This low voltage feature significantly reduces operation cost for electrical power use. The power features of the device are described in more detail below.

Other illumination features are as follows. The body portion 12 includes a first T-shaped ridge 38*a* and an attached first illumination cover 40*a* for covering the first illumination source 30 via a removable attachment with the T-shaped ridge 38*a*. The illumination cover 40*a* and first T-shaped ridge 38*a* are slidably and matingly secured, extending from a top length portion of the first side 32 of the body portion 12 down the length of the body portion 12 to a base or terminal portion 42. Integrally formed on the second side 36 of the body portion 12 is a second T-shaped ridge 38*b* and an attaced second illumination cover 40*b* for covering the second illumination source 31 via a slidably and removable securement with the second T-shaped ridge 40*b*. The second illuminated cover 40*b* and second T-shaped ridge 38*b* are similarly matingly attached, extending from a top length portion of the second side 36 of the body portion 12 down to a base or terminal portion 44 of the second side 36 of the body portion 12.

The illumination covers 40*a*, 40*b* are preferably made of a transparent, hard plastic material. The covers 40*a* and 40*b* have a cross-section which is substantially parabolic. The parabolic configuration has the advantage of uniformly distributing or dispersing light for greater illumination and visibility in dark places.

Figure 3A:
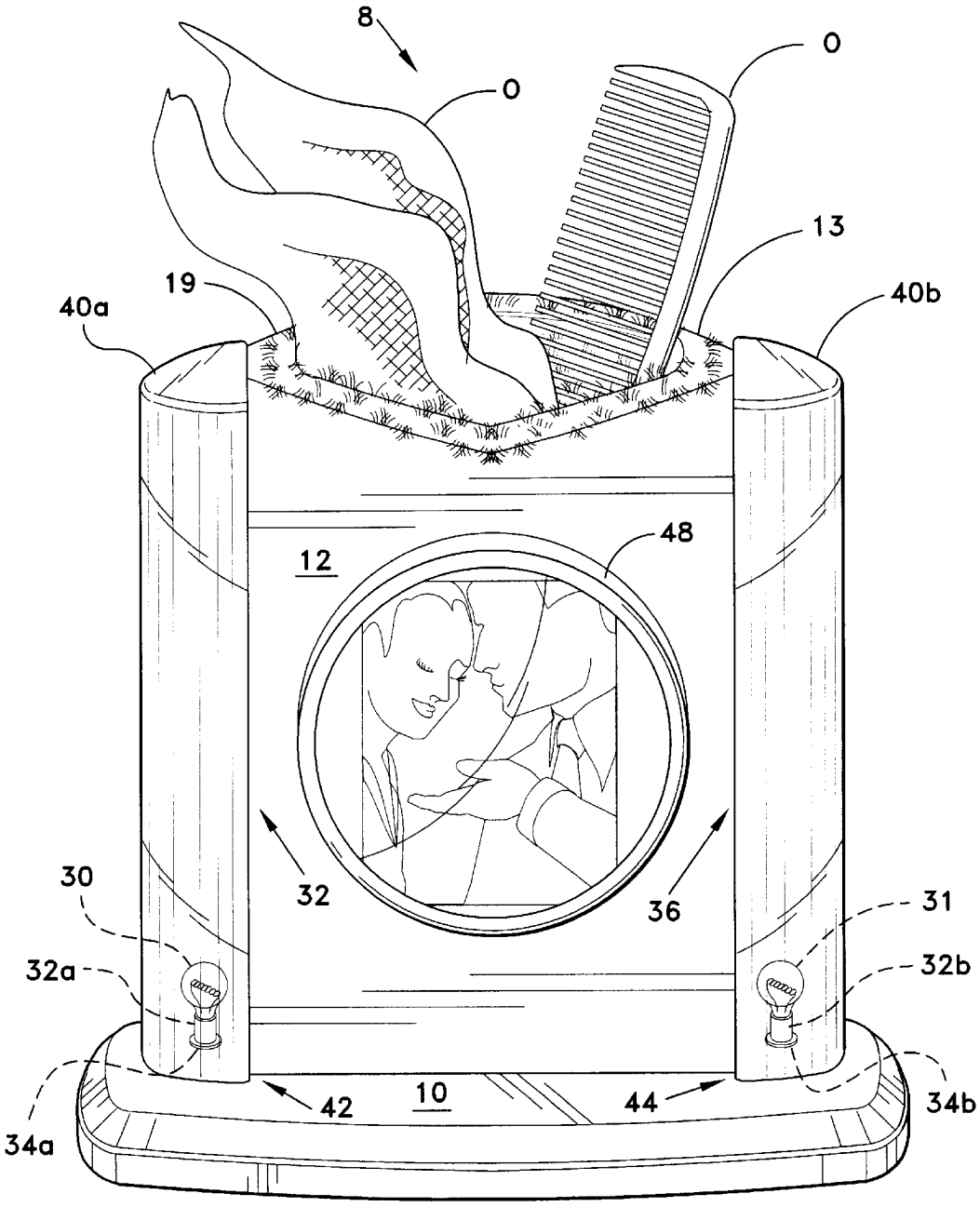
FIG. 3A is a front perspective view of the illuminated holder, illustrating a framed picture element disposed within a central body portion of the illuminated holder according to a second embodiment of the invention.
Figure 3B:
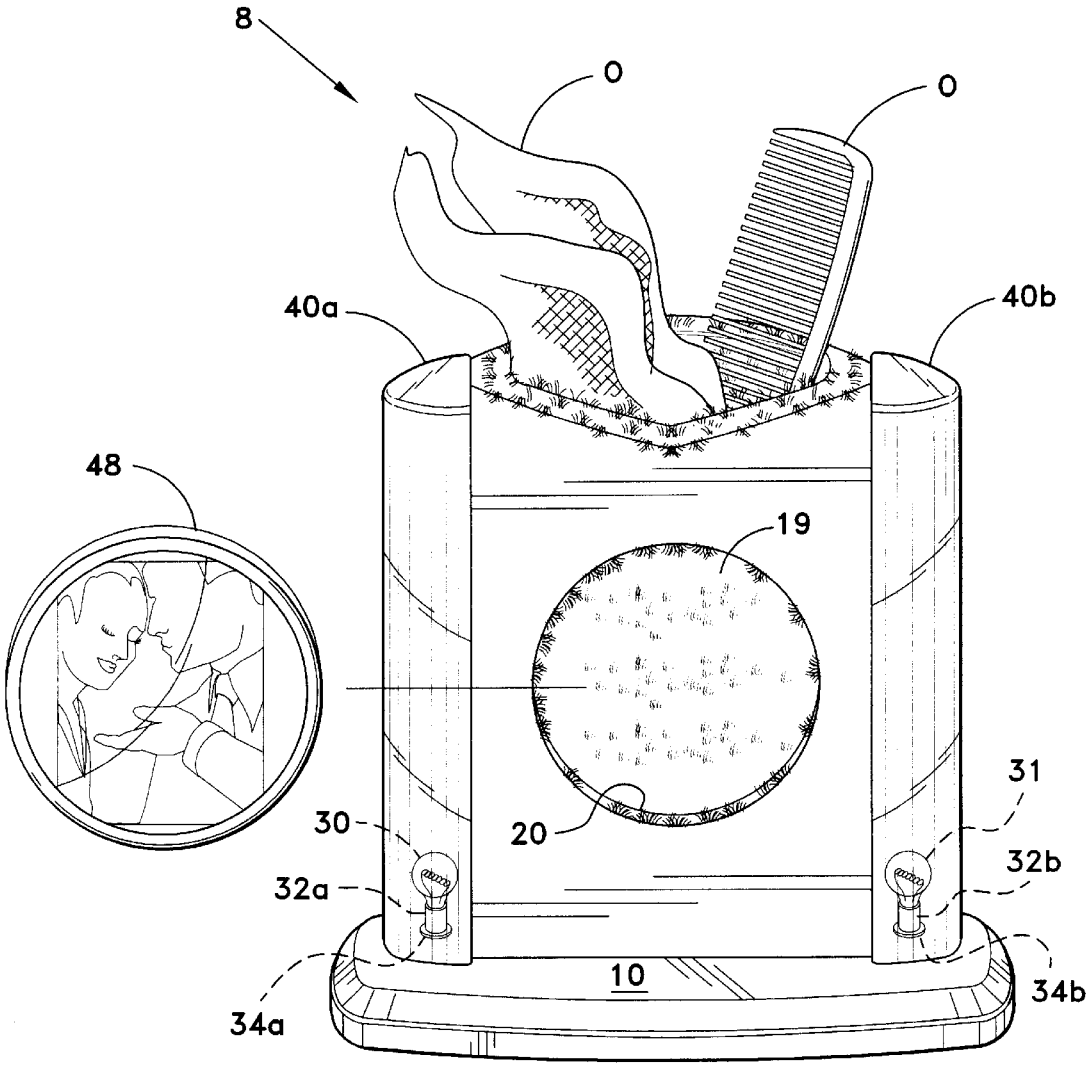
FIG. 3B is a front perspective view of the illuminated holder, illustrating the framed picture element disposed within a central body portion of the illuminated holder, and with objects such as a comb and napkin retained within the holder.

The illuminated holder 8 is shown according to a second embodiment in FIGS. 3A and 3B. The illuminated holder 8 has features similar to holder 7, except where the clock element 22 resides, a central aperture 20 is configured with an alternate arrangement of an exchangeable picture frame element 48. The picture frame element 48 is similarly dimensioned and sized for removable friction fit within the central aperture 20. Other geometrical fits can be similarly provided.

Figure 4:
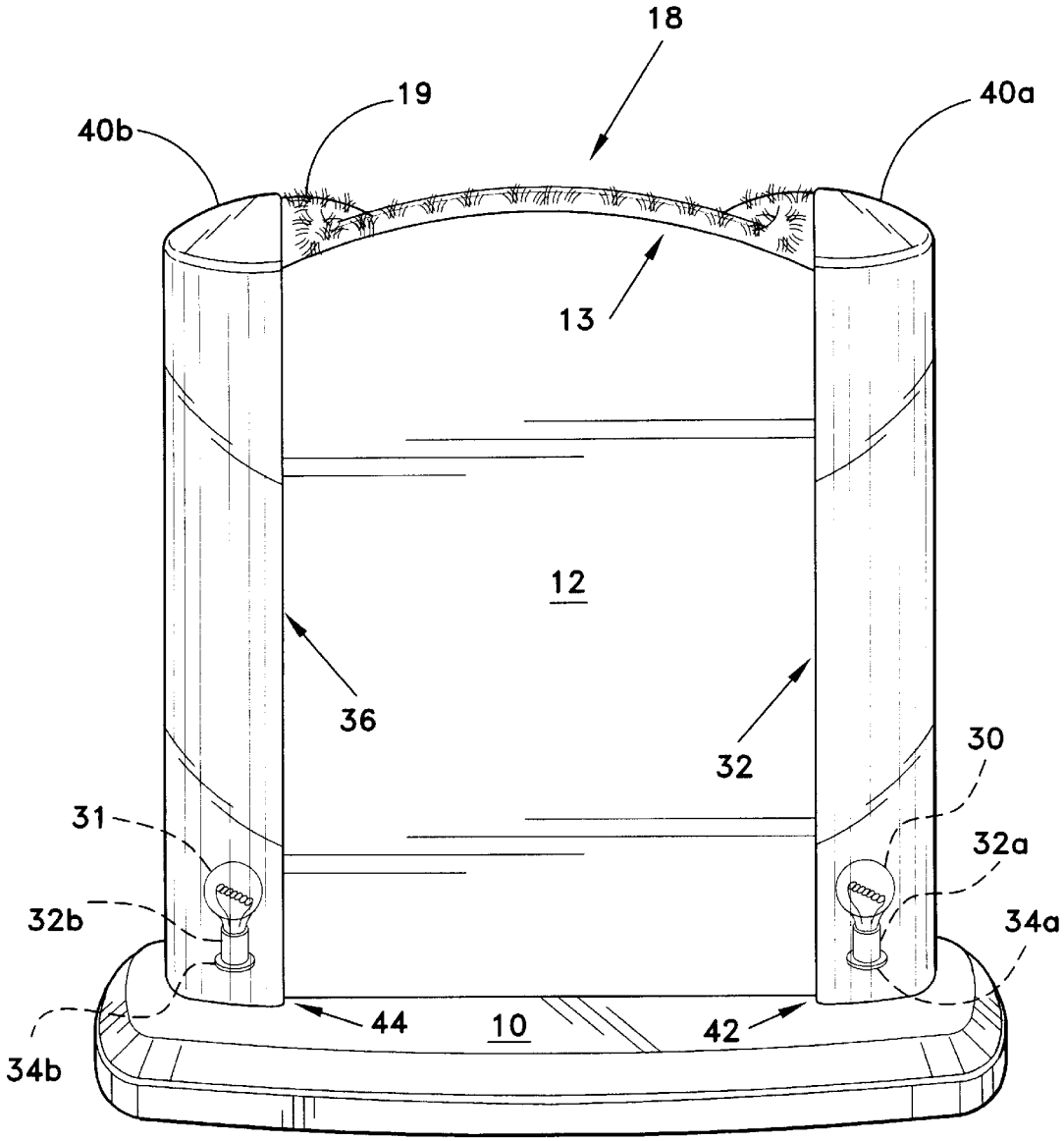
FIG. 4 is a rear perspective view of the illuminated holder.
Figure 5:
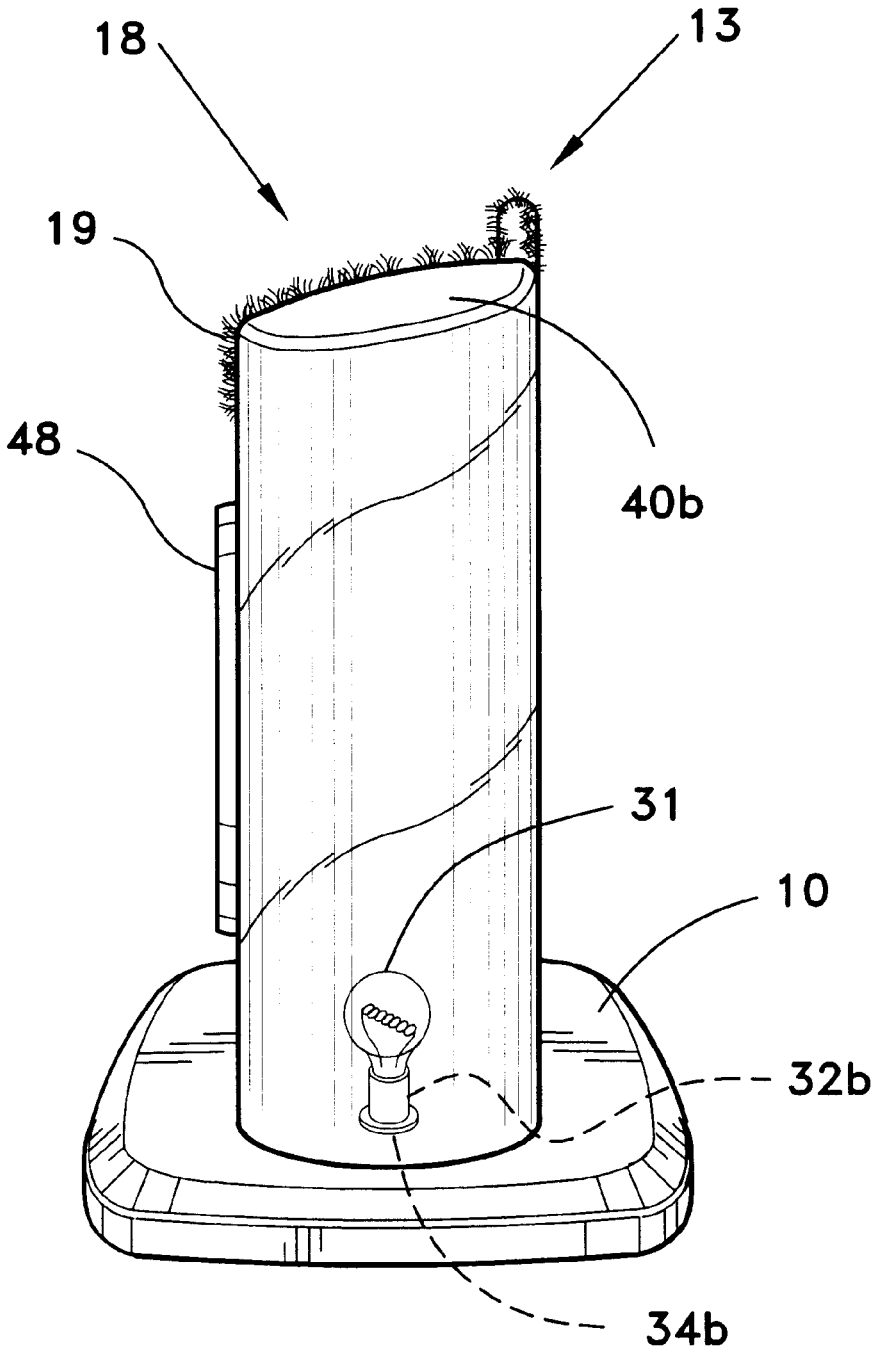
FIG. 5 is a side perspective view of the illuminated holder.
Figure 6:
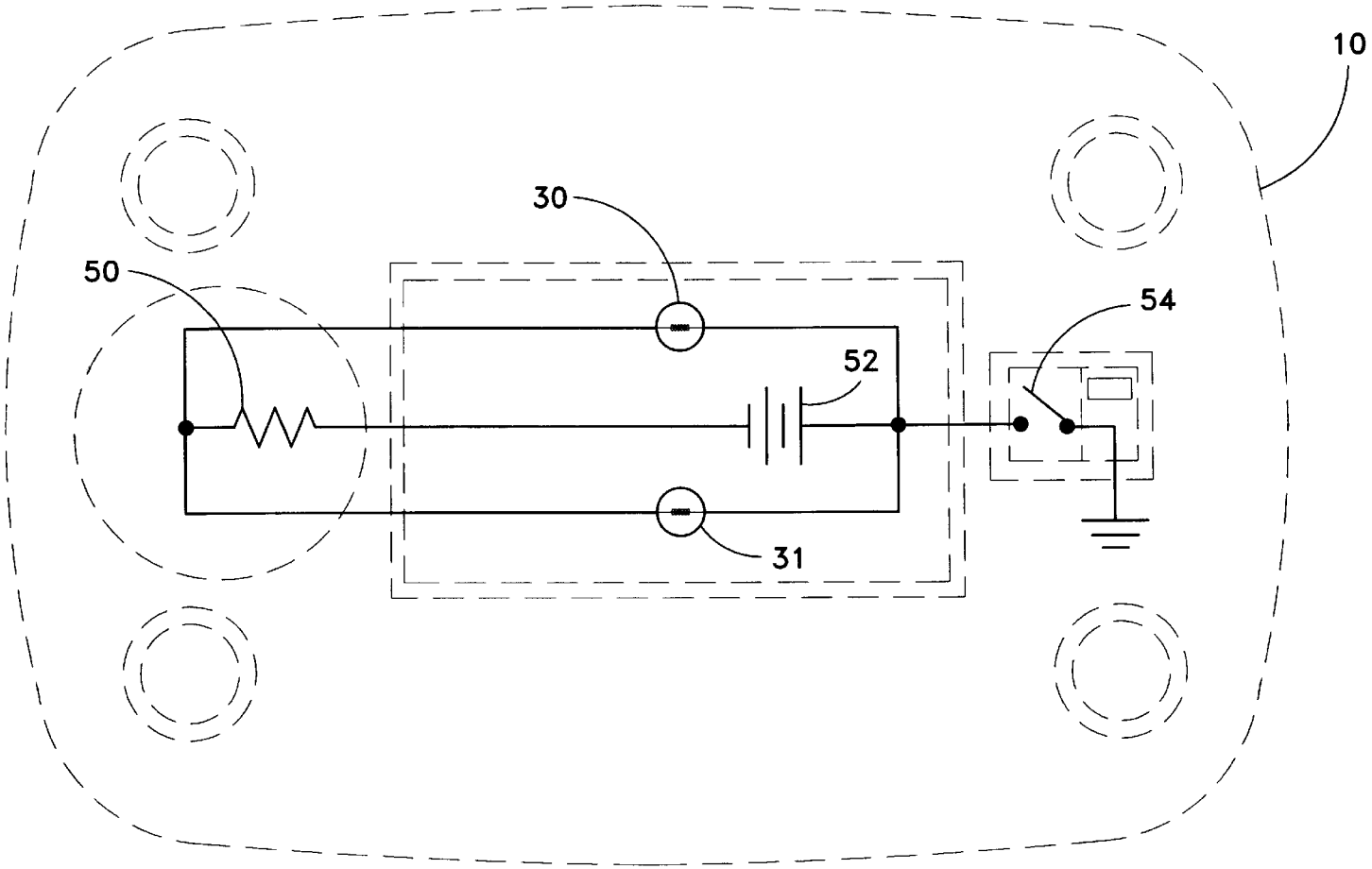
FIG. 6 is a bottom perspective view of the illuminated holder, illustrating an audible sensor circuit.

In both embodiments, rear and side perspectives of the invention 7,8 are similar as diagrammatically illustrated in FIGS. 1 4 and 5. As diagrammatically illustrated in FIG. 6, a bottom perspective view of the invention is shown which includes certain elemental circuit features. There is an audible sensor 50 for sensing audible sounds within a predetermined sensing range up to 21 feet, a power source or battery 52 which drives the circuit with an operating voltage supplied by at least two AA batteries. The power source 52 sequentially supplies power to the sensor 50 such as a variable resistor or the like (such sound responsive elements are widely and commercially available) and first and second illumination sources 30 and 31 as an operative closed loop circuit. A switch 54 of the push button or slidable on/off type can be used for selectively switching power on and off within the circuit. Thus, the illuminated holder 7, 8 is completely run as via a low voltage direct current source. Another advantage of the invention includes the light generated from the holder supplies columns of light to produce a candle effect, but with greater luminosity along the lengths of the respective illuminated sides 14 and 16.

It is to be understood that the present invention is not limited to the embodiments described above, but encompasses any and all embodiments within the scope of the following claims.

I claim:

1. An illuminated holder comprising:

a holder having a base and a body portion, said body portion resting on said base and having a cavity for holding a variety of objects, said holder having a lining material disposed within said cavity of said body portion and extending around a top perimeter portion of said body portion;

at least one sensor for sensing audible sounds within a predetermined sensing range;

a first means for providing illumination of the holder on a first side of the body portion, said first illumination means being operatively and releasably disposed within a first base portion of the holder;

a second means for providing illumination of the holder on an opposing second side of the body portion, said second illumination means being operatively and releasably disposed within a second base portion of the holder, opposing said first base portion;

a power source for sequentially supplying power to said sensor and first and second illumination means as a closed loop circuit; and means for selectively switching power on and off within the circuit.

2. The illuminated holder, according to claim 1, wherein the body portion further comprises a T-shaped ridge and an attachable first illumination cover for removably covering said first illumination means via said T-shaped ridge.

3. The illuminated holder, according to claim 2, wherein said first illumination cover and T-shaped ridge are matingly attached, and extend from a top length portion of the first side of the body portion down to a base portion of the first side of the body portion.

4. The illuminated holder, according to claim 3, wherein said first illumination cover is made of a transparent hard plastic material.

5. The illuminated holder, according to claim 4, wherein a cross-section of said first illumination cover is substantially parabolic.

6. The illuminated holder, according to claim 1, wherein said body portion further comprises a T-shaped ridge and an attachable second illumination cover for removably covering said second illumination means via said T-shaped ridge.

7. The illuminated holder, according to claim 6, wherein said illumination cover and T-shaped ridge are matingly attached and extend from a top length portion of the second side of the body portion down to a base portion of the second side of the body portion.

8. The illuminated holder, according to claim 7, wherein said second illumination cover is made of a transparent hard plastic material.

9. The illuminated holder, according to claim 8, wherein a cross-section of said second illumination cover is substantially parabolic.

10. The illuminated holder, according to claim 1 further comprising a clock element disposed within a central portion of said body portion.

11. The illuminated holder, according to claim 1, wherein said body portion further comprises a central aperture and a picture frame element, said picture frame element being dimensioned and sized to removably fit within said central aperture as a frictional fit.

12. The illuminated holder, according to claim 1, wherein said body portion further comprises a central aperture and an operative clock element, said operative clock element being dimensioned and sized to removably fit within said central aperture as a frictional fit.

13. An illuminated holder comprising:

a holder having a base and a body portion, said body portion resting on said base and having a cavity for holding a variety of objects;

at least one sensor for sensing audible sounds within a predetermined sensing range;

a first means for providing illumination of the holder on a first side of the body portion, said first illumination means being operatively and releasably disposed within a first base portion of the holder;

a second means for providing illumination of the holder on an opposing second side of the body portion, said second illumination means being operatively and releasably disposed within a second base portion of the holder, opposing said first base portion;

said body portion further comprises at least one T-shaped ridge and at least one attachable illumination cover for removably covering at least one of said first and second illumination means via said at least one T-shaped ridge;

a power source for sequentially supplying power to said sensor and first and second illumination means as a closed loop circuit; and means for selectively switching power on and off within the circuit.

14. The illuminated holder, according to claim 13, wherein said at least one illumination cover and said at least one T-shaped ridge are matingly attached, and extend from a top length portion of said body portion down to a base portion of said body portion.

15. The illuminated holder, according to claim 13, wherein said at least one illumination cover is made of a transparent hard plastic material.

16. The illuminated holder, according to claim 13, wherein a cross-section of said at least one illumination cover is substantially parabolic.

17. An illuminated holder comprising:

a holder having a base and a body portion, said body portion resting on said base and having a cavity for holding a variety of objects, said body portion further having a central aperture and one of a picture frame element and an operative clock element, said element being dimensioned and sized to removably fit within said central aperture as a frictional fit;

at least one sensor for sensing audible sounds within a predetermined sensing range;

a first means for providing illumination of the holder on a first side of the body portion, said first illumination means being operatively and releasably disposed within a first base portion of the holder;

a second means for providing illumination of the holder on an opposing second side of the body portion, said second illumination means being operatively and releasably disposed within a second base portion of the holder, opposing said first base portion;

a power source for sequentially supplying power to said sensor and first and second illumination means as a closed loop circuit; and means for selectively switching power on and off within the circuit.

* * * * *